US006922195B2

(12) United States Patent
Satoh et al.

(10) Patent No.: US 6,922,195 B2
(45) Date of Patent: Jul. 26, 2005

(54) IMAGE PROCESSING APPARATUS

(75) Inventors: Yasunori Satoh, Tokyo (JP); Takaaki Akiyama, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 70 days.

(21) Appl. No.: 10/628,436

(22) Filed: Jul. 29, 2003

(65) Prior Publication Data

US 2004/0024983 A1 Feb. 5, 2004

(30) Foreign Application Priority Data

Jul. 30, 2002 (JP) ..... 2002-221158

(51) Int. Cl.[7] ..... G09G 5/39
(52) U.S. Cl. ..... 345/531; 345/574
(58) Field of Search ..... 345/501, 530, 345/531, 534, 98, 213, 572–574, 564; 348/572, 715; 382/304; 386/20, 6; 341/100, 155; 711/200, 100, 154, 1, 2

(56) References Cited

U.S. PATENT DOCUMENTS 5,666,458 A * 9/1997 Moon et al. ..... 386/2
6,239,729 B1 * 5/2001 Takeuchi ..... 382/304
6,590,616 B1 * 7/2003 Takeuchi ..... 348/572
2002/0011985 A1 * 1/2002 Nakano et al. ..... 345/98

* cited by examiner

*Primary Examiner*—Kee M. Tung
(74) *Attorney, Agent, or Firm*—Rabin & Berdo, PC

(57) ABSTRACT

An image processing apparatus includes a memory circuit, one-line judging circuit, a write control circuit and a read control circuit. The memory circuit stores an input data in response to a write address and outputs an output data in response to a read address. The one-line judging circuit receives a horizontal synchronization signal and a sampling clock signal and compares a number of pixels sampled within one line of the horizontal synchronization signal with a predetermined number so as to output a comparison signal and a difference signal representing a difference between the sampled number and a predetermined number. The write control circuit generates the write address in response to the clock signal and the comparison signal, and a read control signal in response to the comparison signal. The read control circuit generates the read address in response to the write address, the read control signal and the difference signal.

20 Claims, 9 Drawing Sheets

FIG. 5A PICTURE SIGNAL

FIG. 5B FIFO (W)

FIG. 5C FIFO (R)

FIG. 5D PICTURE SIGNAL

FIG. 5E FIFO (W)

FIG. 5F FIFO (R)

IMAGE PROCESSING APPARATUS

BACKGROUND OF THE INVENTION

The present invention is related to an image processing apparatus in which, for instance, data produced by sampling a supplied picture signal is written into a memory, and then read timing of this stored data is adjusted.

Normally, a total number of pixels per 1 line of a picture signal is determined. For instance, in the case of the NTSC (National Television System Committee) technical specification, assuming now that a sampling frequency of a horizontal direction is selected to be 13.5 MHz, a total number of pixels per 1 line becomes 858 pixels. However, in a so-called "non-standard signal", these 858 pixels are not always employed. Also, even when a standard signal is used, in such a case that an asynchronous sampling clock is used in a digital sampling process operation, sampling positions are made different from each other by using this asynchronous sampling clock. As a result, pixel numbers may be made different from each other.

In an actual case, when a total pixel number of a 1H line is not constant, such a phenomenon happens to occur in an image displayed on a monitor, resulting in a derioration of an image (picture) quality. As this phenomenon, zigzag portions are produced in edges within the image, and/or a longitudinal straight line within the image is shifted. As a method of maintaining image qualities, a pixel adjusting circuit employs a FIFO (First-In First-Out) memory, a 1-H judging unit, a write control unit, and a read control unit. The FIFO memory stores thereinto data to be inputted, and outputs such a data that has been stored by performing a time adjustment. Although a memory capacity of the FIFO memory is not limited, 0.5 to 1 k words are properly selected as this memory capacity. Generally speaking, in order that a memory capacity of a FIFO memory is saved and a data transfer operation is carried out in a higher efficiency, this memory capacity is selected to be smaller than a 1H line.

The 1-H judging unit contains a counter and a pixel number judging unit. While an interval from a threshold which has been previously set with respect to the horizontal sync signal up to a next threshold is defined as an interval of a 1H line, the counter counts this interval by using a sampling clock, and then sets the count value as a total pixel number within the 1H line in an input picture signal. The counter supplies the count value to the pixel number judging unit. In this case, a horizontal sync signal corresponds to such a signal that is obtained by sync-separating the supplied picture signal by the existing sync separating circuit. The horizontal sync signal is employed as a signal for resetting the counter every 1H line.

While the pixel number judging unit employs the supplied count value as the pixel number and compares this count value with a predetermined pixel number (standard value) which is written into the memory within the 1H line, this pixel number judging unit sends data to the write control unit, and this data is controlled in response to a position of data to be written. This data is a comparison result, and when a count value within a 1H line is smaller than the predetermined pixel value, the pixel numbers judging unit outputs (−), whereas when a count value within the 1H line is equal to the predetermined pixel value, the pixel number judging unit outputs (0). Then when a count value within a 1H line is larger than the predetermined pixel value, the pixel number judging unit outputs (+). Also, the pixel number judging unit also supplies a difference between a count value and a predetermined pixel number.

Although not shown in the drawing, the write control unit contains a write control circuit and a write counter. The write control unit owns such a function capable of controlling a write address of input data that is supplied to the FIFO memory. To accomplish this function, the write control circuit outputs a control signal for designating starting of a counting operation to the write counter, and sets an interval between a write starting address and a read starting address in the FIFO memory as a phase difference. In the case that the storage capacity of the FIFO memory is assumed as "n", this phase difference is set to a half value of this capacity "n". The write control circuit supplies this half capacity value (n/2) to the read control circuit. Also, the write control circuit also performs a write prohibit control operation with respect to the write counter. The write counter counts input data in response to a sampling clock that is supplied from the commencement of the counting operation, and outputs the count value as a write address to the FIFO memory. This count value is also supplied to the read control circuit.

Also, the read control unit contains both a read control circuit and a read counter. The read control unit owns such a function that a commencement of the reading operation is notified to the read counter, and a control signal for starting the counting operation is outputted. The read counter starts its counting operation in response to the supplied control signal, and subsequently is operated in a free running mode in response to the sampling clock. The read counter supplies the count value as a read address to the FIFO memory.

Operations executed in the pixel adjusting circuit will now be simply explained. The sampled input data are sequentially written into the FIFO memory from a head of the 1H line, and after predetermined time has passed, the data written in this FIFO memory are read. In this case, the memory capacity of the FIFO memory is equal to "n", and corresponds to such a memory capacity smaller than the predetermined sampling number (pixels) within the 1H line.

In this case, the predetermined time corresponds to the above-described phase difference. After a half of the phase difference has been written into the FIFO memory, the reading operation is commenced. A position of the phase difference is n/2. Also, a pixel number obtained in the case that a 1H line is sampled based upon the above-described sampling frequency of 13.5 MHz is equal to 858.

The pixel number judging unit notifies to the write control unit, a first case that the pixel number of the 1H line is equal to the standard value (858); a second case that the pixel number of the 1H line is larger than the standard value (858); and also, a third case that the pixel number of the 1H line is smaller than the standard value (858). In the first case, the write control unit judges that this condition is the normal operation, and thus, supplies the write address to the FIFO memory. While the relationship of the phase difference is maintained, the read control unit supplies the read address to the FIFO memory. As a result, the input data are sequentially and continuously inputted/outputted.

However, in the second case in which the count value in the pixel number judging unit is different from the standard value, the write control circuit performs such a write prohibit control operation. That is, both such a judgment result (+) that the pixel number of the input data is larger than the standard value per 1H line, and a difference of the supplied pixel number are not written into the FIFO memory. In other words, the increased pixels within the supplied input data are not written into the FIFO memory. Since this write prohibit control operation is carried out, the same pixel number as the standard value is written into the FIFO memory as the pixel number of the line, so that the read circuit reads out the data under the same control as the normal control operation.

To the contrary, in the third case, the write control circuit executes such a write controlling operation. That is, this write control circuit writes the input data of the 1H line, skips addresses of shortages of pixel values, and then executes the process operation with respect to the next 1H line. Also, in this third case, the read control unit executes the same control operation as the normal operation and outputs a predetermined pixel number.

As explained above, when the write control unit executes the write control operation of the input data with respect to the FIFO memory, this write control units manages the phase difference so as to perform the pixel management. Also, in this process operation, either a shift of the phase differences or a difference thereof is given to both an input signal and an output signal. This difference is absorbed by executing such a process operation that the phase difference is returned to a default value every 1 field, and thus, this difference may be canceled. Since such a process operation is carried out so as to adjust the pixel number per 1H line, the picture output may be properly obtained.

On the other hand, in the third case, the write address is adjusted in order to control that the shortage of addresses are skipped on the data writing side, whereas the normal read control is carried out so as to output a constant pixel number in the normal manner. In this case, the input data that has been written in the memory area before this shortage of these pixel numbers occurred is not rewritten, but is left. This memory area corresponds to the addresses skipped by the write control operation of the FIFO memory. As a consequence, if the data reading operation is carried out in the normal manner, then this remaining data is also read. In the case that there is a difference between the present data and the data that has been written before the shortage of pixel numbers occurred, or there is no correlative relationship between these data, dot noise will appear as so-called "flickering noise" on the display screen in correspondence with this pixel.

Also, since the input error is processed by the error absorbing process operation for resetting the input data in a batch manner every 1 field, either the shift or the difference is gradually stored during 1 field, and therefore is gradually increased. As a result, such a phenomenon will occur in the resulting image. That is, such an observation is made that an upper portion of this image is shifted from a lower portion thereof, and disturbance produced in a half way of the image is continued until the end of this field.

SUMMARY OF THE INVENTION

The present invention has been made to solve the above-described drawbacks of the conventional techniques, and therefore, has an object to provide such an image processing apparatus capable of producing a noiseless image, or an image having no disturbance, which are caused by adjusting a total number of pixels.

An image processing apparatus, according to an aspect of the present invention, is featured by such an image processing apparatus comprising: memory means in which input data obtained by sampling a picture signal to be supplied by using a sampling clock is temporarily written to be stored, and input data which has already been written is read therefrom; line judging means for comparing/judging a pixel obtained by counting a 1 line of the picture signal by using the sampling clock with a predetermined pixel number in the 1 line, and for outputting a comparison result and a difference of pixels obtained from the comparison; write control means for controlling a production of a write address with respect to the input data in response to the comparison result and the difference of the pixel numbers, and for outputting the controlled write address to the memory means; and read control means operated in such a manner that while time defined from a writing start of a horizontal sync signal in the picture signal written into the memory means until a half value of a memory storage of the memory means has elapsed is set as a phase difference, and also at the same time when the phase difference has elapsed, the write address of the writing start is set as a read address of a reading start, a production of the read address is controlled to be outputted to the memory means; wherein: the read control means includes: a register for storing thereinto both the difference of the pixel numbers outputted from the line judging means and also a write address of a final pixel within a 1 line, which is written in response to a control signal for permitting a writing operation, which is produced by the write control means, and a judgment result of such pixel numbers smaller than the predetermined pixel number, which is judged by the line judging means; and for outputting both the write address of the final pixel and the difference of the pixel numbers in response to the sampling clock for a time period during which a control signal for permitting a reading operation is supplied; a read adjusting means for producing the read permission control signal, for comparing the write address of the final pixel with the read address, for producing a switch control signal capable of selecting the write address of the final pixel plural times indicated by the difference of the pixel numbers in accordance with a coincidence of the comparison result, and also for resetting the register while the selection control signals are outputted plural times; and selecting means for selecting the write address of the final pixel during a time period equal to the plural times in accordance with a coincidence between the write address of the final pixel and the read address.

BRIEF DESCRIPTION OF THE DRAWINGS

For a better understanding of the present invention, reference is made of a detailed description in conjunction with the accompanying drawings, in which.

DESCRIPTION OF THE PREFERRED EMBODIMENTS

Referring now to accompanying drawings, various embodiments of image processing apparatus according to the present invention will be described in detail.

This embodiment corresponds to such a case that the image processing apparatus of the present invention has been applied to a pixel timing adjusting apparatus 10. It should be noted that structural portions that have no direct relationships with the present invention are not illustrated and explanations thereof are omitted. It should also be understood that signals are designated by using reference numbers of connection lines on which these signals appear in the below-mentioned explanations.

Figure 1:
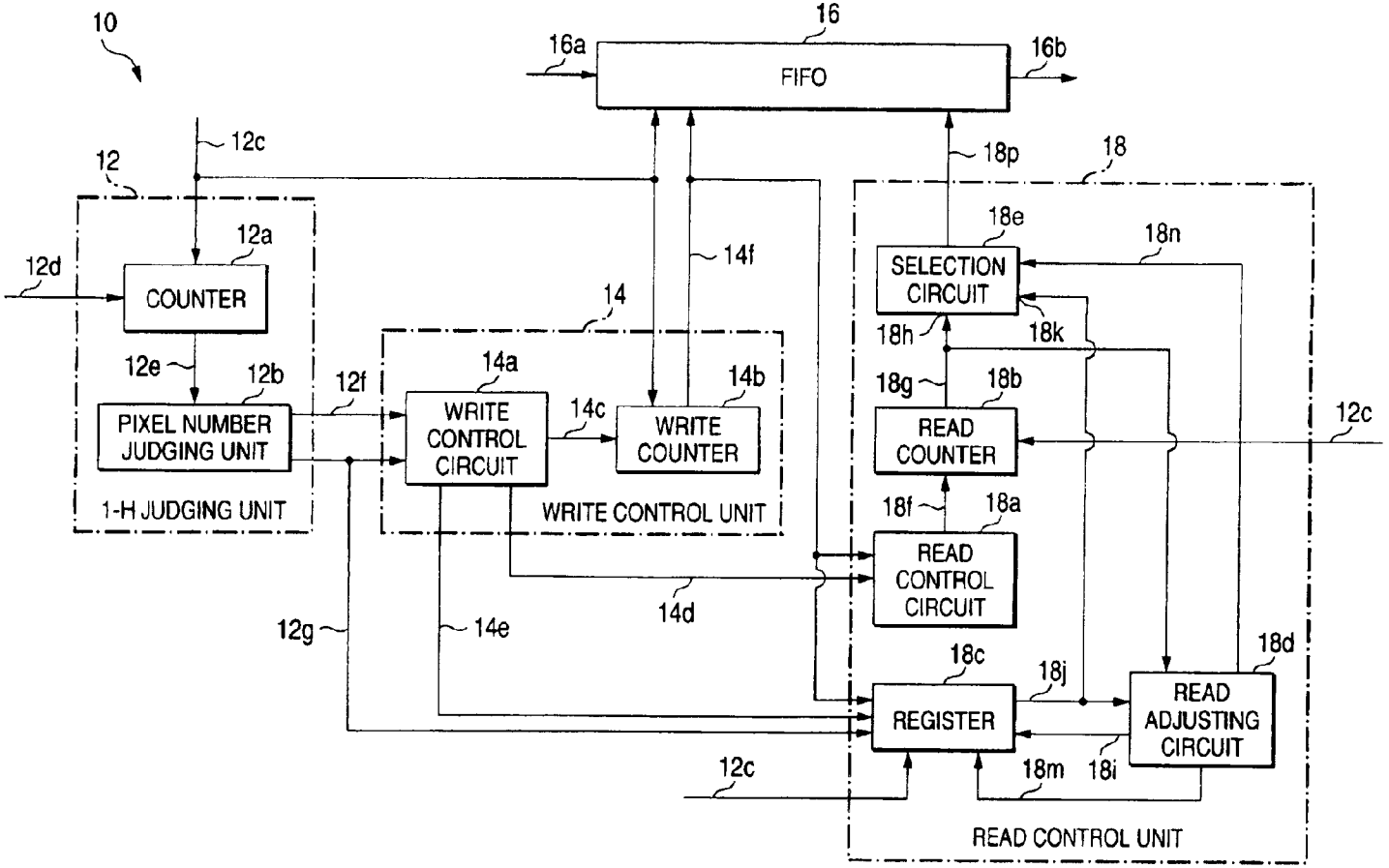
FIG. 1 is a block diagram for schematically indicating an arrangement of a pixel timing adjusting apparatus to which an arrangement of an image processing apparatus according to the present invention is applied.

As shown in FIG. 1, the pixel timing adjusting apparatus 10 contains a 1-H judging unit 12, a write control unit 14, a FIFO memory 16, and a read control unit 18. The 1-H judging unit 12 contains a counter 12*a* and a pixel number judging unit 12*b*. The 1-H judging unit 12 owns such a function capable of judging as to whether or not a total number of pixels which are sampled within a 1H line supplied as a picture signal is equal to a preselected pixel number. A horizontal sync (synchronization) signal 12*d* is supplied to the 1-H judging unit 12. This horizontal sync signal 12*d* indicates a section between a sampling clock 12*c* and a 1H line. The sampling clock 12*c* employs, for example, 13.5 MHz as a clock frequency. Since this clock frequency is employed, the counter 12*a* counts 858 clock counts (namely, full count), since the horizontal scanning frequency defined in the NTSC technical specification is equal to $f_H$=15.734 KHz. The counter 12*a* resets its counted value in response to a falling edge of the supplied horizontal sync signal 12*d*. The counter 12*a* outputs a count value 12*e* to the pixel number judging unit 12*b*.

The pixel number judging unit 12*b* judges as to whether the above-described 858 clock counts are larger than, or smaller than the count value 12*e* with respect to a predetermined pixel number to be sampled. As the large/small relationship, the respective judgment results are given as follows: a smaller case (−), an equal case (0), and a larger case (+). The pixel number judging unit 12*b* supplies a judgment result 12*f* to the write control unit 14. Also, in such a case that the supplied pixel number is smaller than a predetermined pixel number, the pixel number judging unit 12*b* calculates a difference between these pixel numbers, and then, reads the calculated difference 12*g* to output this read difference 12*g* to the read control unit 18. Also, in such a case that the supplied pixel number is larger than a predetermined pixel number, the pixel number judging unit 12*b* calculates a difference between these pixel numbers, and then, outputs the calculated difference 12*g* the write control unit 14*a*.

The write control unit 14 contains both a write control circuit 14*a* and a write counter 14*b*. The write control circuit 14*a* supplies such a counter control signal 14*c* for controlling the counting operation of the write counter 14*b* to the write counter 14*b*. The counter control signal 14*c* instructs the write counter 14*b* to start the counting operation, and also instructs this write counter 14*b* to prohibit a writing operation of an increased pixel of the input data (pixel) when the pixel number of this input data is larger than a predetermined number. Since the write control circuit 14*a* receives both an operation starting signal 14*d* indicative of starting of the operation and such a fact that the pixel number in the 1H line is smaller than the predetermined pixel number, the write control circuit 14*a* outputs this read data write enable signal 14*e* to the read control unit 18.

The write counter 14*b* is provided in accordance with a memory capacity "n" of a FIFO memory 16. In this embodiment, since the memory capacity "n" of this FIFO memory 16 is set to be smaller than the total pixel number of the 1H line, such a counter for counting pixel numbers smaller than the predetermined pixel numbers 858 is prepared. The write counter 14 is provided with the sampling clock 120. The write counter 14*b* outputs this count value 14*f* as a write address to both the FIFO memory 16 and the read control unit 18.

As the FIFO memory 16, such a dual type FIFO memory may be preferably used by which the capacity "n" of the FIFO memory 16 is smaller than the total pixel number of the 1H line, and both an input operation and an output operation can be performed at the same time. In order that such an operation can be carried out, both write timing and read timing are controlled in such a manner that both process operations are not overlapped with each other in the FIFO memory 16, while an interval between a falling edge of a horizontal sync signal indicating a start of writing operation, and a falling edge of a horizontal sync signal indicating a start of reading operation is employed as a phase difference. This FIFO memory 16 is operated in response to the sampling clock 12*c*. A picture signal of the NTSC specification that has been sampled at the sampling clock 12*c* and has been held for a predetermined time period is supplied as input data 16*a* into the FIFO memory 16. The supplied input data 16*a* is written into a corresponding address within the FIFO memory 16 in response to the write address 24*f*, whereas the input data 16*a* which has been stored in a corresponding address within the FIFO memory 16 is read out in response to a read address supplied from a read control unit 18 (will be explained later), and this read data 16*a* is outputted as output data 16*b*. It should also be understood that while the supply of the input data 16*a* is adjusted, or controlled by considering a time duration required for a write control operation (not shown), this input data 16*a* is supplied to the FIFO memory 16.

The read control unit 18 contains a read control circuit 18*a*, a read counter 18*b*, a register 18*c*, a read adjusting circuit 18*d*, and a selection circuit 18*e*. Both the operation starting signal 14*d* derived from the write control circuit 14*a* and the write address 14*f* derived from the write counter 14*b* are supplied to the read control circuit 18*a*. A half value of the memory capacity "n" owned by the FIFO memory 16 has been previously stored as a phase difference into the read control circuit 18*a*. This phase difference has been converted into a count value, and then, this count value has been stored in this read control circuit 18*a*. It should also be noted that a half value of the memory capacity "n" may be supplied from an external source to the read control circuit 18*a*.

The read control circuit 18*a* judges as to whether or not the count number of the write address 14*f* that is supplied after the operation starting signal 14*d* has been received is made coincident with a count number of a preset phase difference. The read control circuit 18*a* reads out a counter control signal 18*f* in response to a coincidence judgment result, and then outputs the read counter control signal 18*f* to the read counter 18*b*.

The read counter 18*b* is provided in coincident with the capacity "n" of the FIFO memory 16. As the read counter

18*b*, the same counter as the write counter 14*b* is used. While the sampling clock 12*c* is supplied to the read counter 18*b*, this read counter 18*b* commences a read counting operation in response to the supply of the counter control signal 18*f*, and thus counts at the timing of the sampling clock 12*c*. The read counter 18*b* supplies a read count 18*g* as a read address to one terminal 18*h* of the selection circuit 18*e*.

The register 18*c* stores thereinto such a write address corresponding to a final pixel and a difference 12*g* of pixels contained in the write address 14*f*, and outputs the write address stored during the reading operation to the read adjusting circuit 18*d*. In order to perform this writing/reading operation, both the data write enable signal 14*e* derived from the write control circuit 14*a* and the data read enable signal 18*i* derived from the read adjusting circuit 18*d* are supplied to this register 18*c*, and this register 18*c* is operated by the sampling clock 12*c*.

When the data write enable signal 14*e* is supplied to the register 18*c*, this register 18*c* stores thereinto both the write address 14*f* (count value) and the difference 12*g* of the pixels respectively, which are supplied at this time. This write address 14*f* corresponds to such a write address used to store the final pixel in the 1H line. Also, within a time period during which the data read enable signal 18*i* supplied from the read adjusting circuit 18*d* is supplied to the register 18*c*, this register 18*c* supplies the write address 14*f* which has been stored in response to a rising edge of the sampling clock 12*c* as a read address 18*j* to both the read adjusting circuit 18*d* and another terminal 18*k* of the selection circuit 18*e*. Also, a reset signal 18*m* is supplied from the read adjusting circuit 18*d* to the register 18*c*.

During the enable time period of the data read enable signal 18*i*, both the read counter 18*g* and a read address 18*j* (namely, write address 14*f*) are inputted to the read adjusting circuit 18*d* so as to perform an address comparing operation. Although not shown in the drawing, the data read enable signal 18*i* corresponds to a signal obtained by inverting, for example, the data write enable signal 14*e*. In particular, the read adjusting circuit 18*g* outputs a switch control signal 18*n* to the selection circuit 18*e* in response to a coincidence of the compared addresses. The read adjusting circuit 18*g* produces the switch control signal 18*n* in such a manner that this switch control signal 18*n* is outputted over an adjusting time period which is expressed by a product made between the sampling clock period and an output number as the number of pixel difference 12*g*. After the output time period for the switch control signal 18*n* has elapsed, the read adjusting circuit 18*d* supplies a reset signal 18*m* to the register 18*c* so as to delete the stored data.

In the selection circuit 18*e*, the read count 18*g* derived from the read counter 18*b* is supplied as a read address to an input terminal 18*h* thereof, whereas the write address 14*f* read out from the register 18*c* is supplied as a read address 18*j* to another input terminal 18*k* thereof. The selection circuit 18*e* selects to output the read address supplied in response to the switch control signal 18*n*. In other words, the selection circuit 18*e* selectively outputs the read address 18*j* during the adjusting time period after the coincidence of the compared addresses, and selectively outputs the read count 18*g* as the read address during a time period other than the above-described adjusting time period. The selection circuit 18*e* supplies a selected read address 18*p* to the FIFO memory 16.

With employment of this arrangement, in such a case that the total pixel number of the input data is smaller than the predetermined pixel number in the 1H line, the read control operation is carried out as follows. That is, while both the write address corresponding to the final pixel of the input data supplied as the 1H line and the shortage number (namely, difference in pixel numbers) are stored in the register 18*c*, the selection circuit 18*e* is switched by receiving the switch control signal 18*n* supplied from the read adjusting circuit 18*d* during the read control operation with respect to the FIFO memory 16, the address of the final pixel is repeatedly accessed to the pixels which have been dropped after the final pixel read out from the register 18*c*. As a result, the predetermined pixel number is fully prepared, and the same data as the final pixel is supplied, so that a failure occurred on the screen in this case can be avoided. The operations will be explained in more detail in the below-mentioned description.

Figure 2:
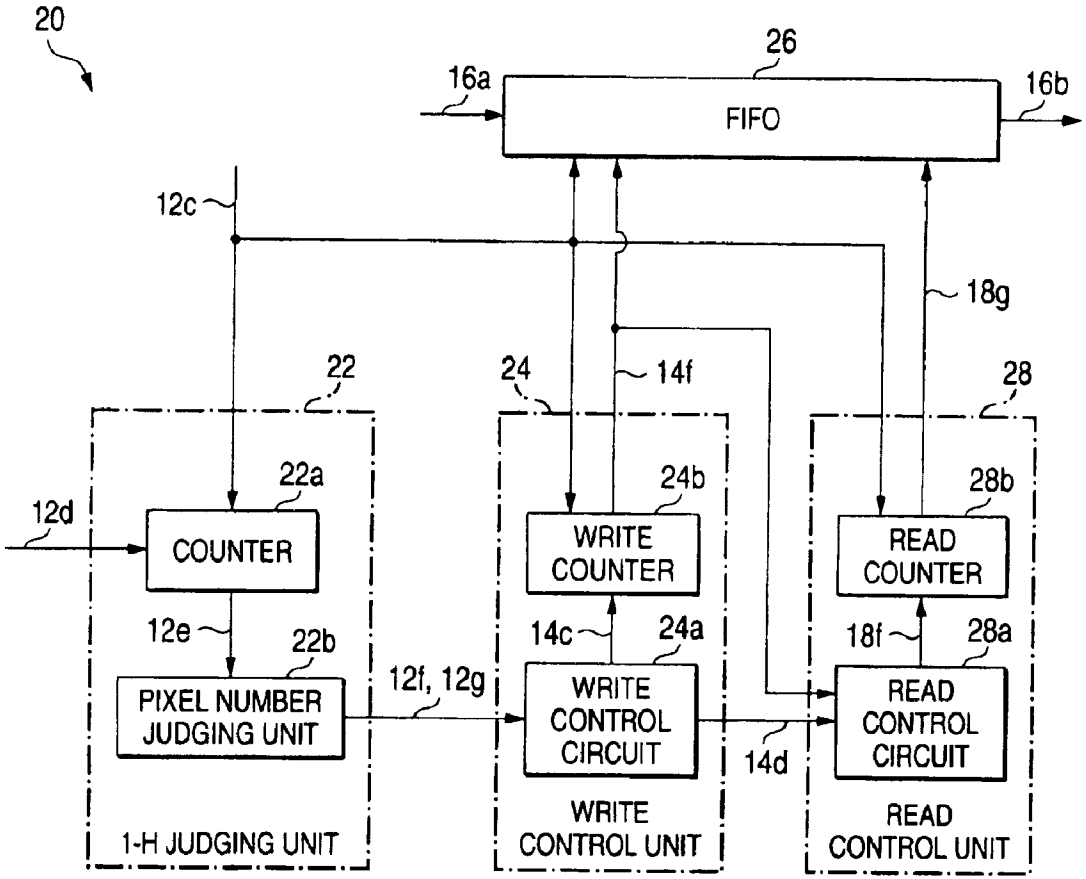
FIG. 2 is a block diagram for schematically showing an arrangement of a comparison example with respect to the pixel timing adjusting apparatus of FIG. 1.

Next, a comparison example with respect to the above-described pixel timing adjusting apparatus 10 is shown in FIG. 2, and explanations thereof will now be made. A pixel timing adjusting apparatus 20 (comparison example) owns the same structural elements as these of FIG. 1. In other words, these structural elements are a 1-H judging unit 22, a write control unit 24, a FIFO memory 26, and a read control unit 28. The same reference numerals shown in FIG. 1 will be employed as those for indicating commonly used signals. The 1-H judging unit 22 contains a counter 22*a* and a pixel number judging unit 22*b*. The write control unit 24 contains a write control circuit 24*a* and a write counter 24*b*. Then, the read control unit 28 contains a read counter 28*a* and a read control circuit 28*b*.

When the pixel timing adjusting apparatus 10 of FIG. 1 is compared with this pixel timing adjusting apparatus 20, the same structural elements are employed in the 1-H judging unit 22 and the write control unit 24, where as only the read control circuit 28*a* and the read counter 28*b* are contained in the read control unit 28. As apparent from FIG. 2, in this read control unit 28, the register 18*c*, the read adjusting circuit 18*d*, and the selection circuit 18*e* are not contained which are indicated in FIG. 1.

A different point with respect to the pixel timing adjusting apparatus 10 will now be listed up. In the 1-H judging unit 22, both a judgment result 12*f* and a difference 12*g* of pixel numbers are supplied from the pixel number judging unit 22*b* to the write control unit 24. In the case that a pixel number is larger than a result of the judgment result 12*f*, the write control circuit 24*a* supplies such a write control signal 14*c* for neglecting an increased pixel number. In the case that a pixel number is smaller than a result of the judgment result 12*f*, the write control circuit 24*a* produces such a write control signal 14*c* based upon an address jump by neglecting a shortage of pixel number, and then supplies this write control signal 14*c* to the write counter 24*b*. In the later case, the write control circuit 24*a* immediately executes the write address control operation with respect to the next line. Also, the write control circuit 24*a* supplies an operation starting signal 14*d* to the read control circuit 28*a*.

In the read control unit 28, while both the operation starting signal 14*d* and the write address 14*f* are supplied to the read control circuit 28*a*, this read control circuit 28*a* judges as to whether or not time of a phase difference has passed based upon a previously-stored phase difference, and after this time has passed, the read control circuit 28*a* outputs a counter control signal 18*f* to the read counter 28*b* so as to commence the counting operation thereof. This counter control signal 18*f* corresponds to a trigger signal capable of commencing the counting operation of the read counter 28*b* by maintaining a relationship of the phase difference. The read counter 28*b* is operated in a free running mode after the counting operation thereof has been commenced. The read counter 28*b* reads a count value and then supplies this read count value as a read address 18*g* to the FIFO memory 26.

Figures 3A, 3B, 3C, 3D, 3E, 3F, 3G, 3H, 3I:
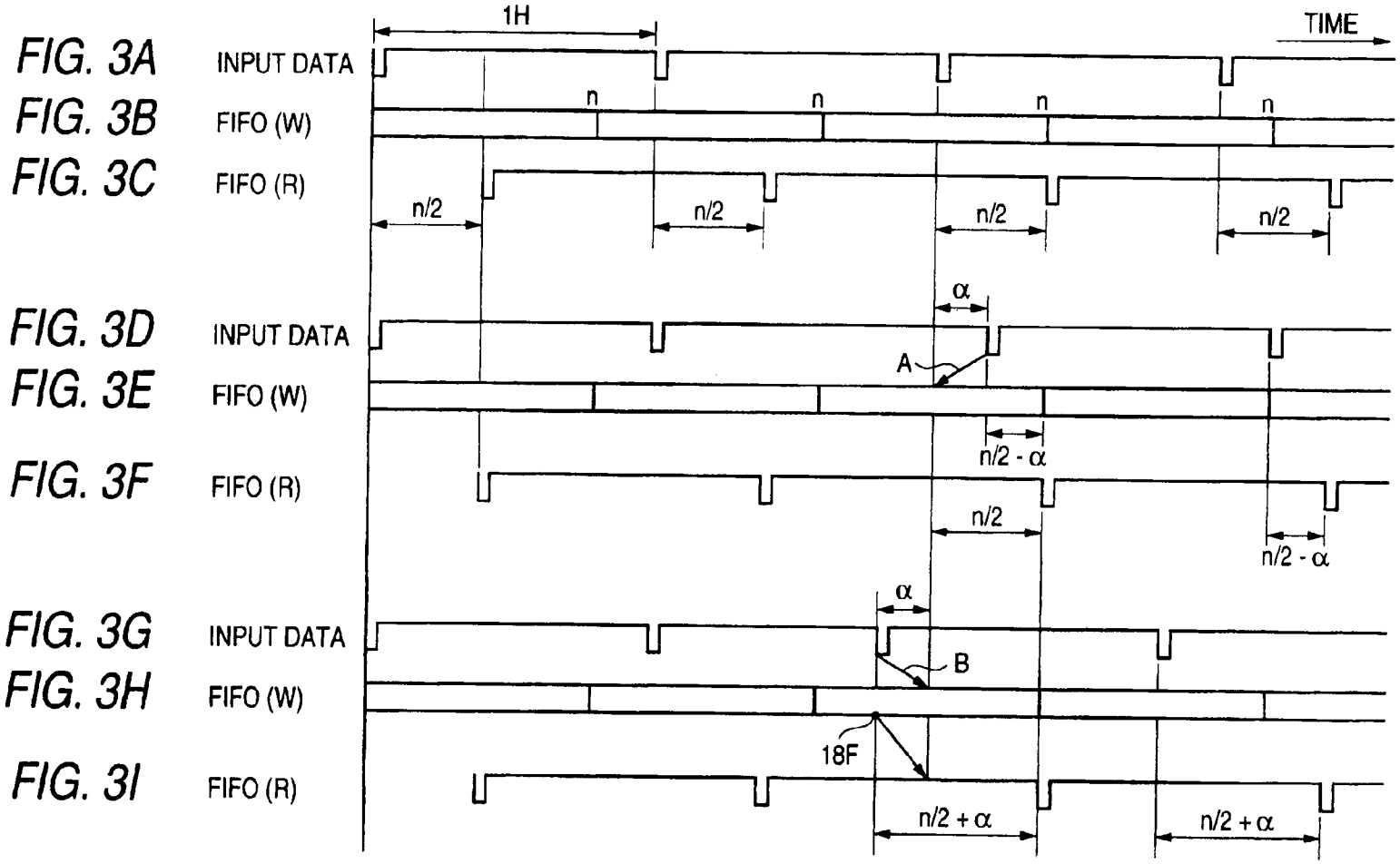
FIG. 3 is a timing chart for describing controlling operations of a FIFO memory employed in the pixel timing adjusting apparatus shown in FIG. 1 and FIG. 2.

Next, a relationship between write control timing and read control timing with respect to the FIFO memory 16 and the FIFO memory 26 will now be simply explained by employing a timing chart of FIG. 3. The timing chart of FIG. 3 represents: such a case (FIGS. 3A, 3B, and 3C) that a predetermined pixel number is sampled in a 1H line; such a case (FIGS. 3D, 3E, and 3F) that a pixel number larger than the predetermined pixel number is sampled; and also, such a case (FIGS. 3G, 3H, and 3I) that a pixel number smaller than the predetermined pixel is sampled. As previously explained, in this case, both the FIFO memory 16 and the FIFO memory 26 use the memory capacities "n" lower than the predetermined pixel number (858) within the 1H line. The phase difference is set to a half value (namely, n/2) of this memory capacity "n".

Input data 16*a* of FIG. 3A produced by sampling a picture signal are sequentially written into the FIFO memory 16 shown in FIG. 3B, and after the phase difference has elapsed, output data 16*b* are sequentially read out from this FIFO memory 16 as represented in FIG. 3C. When a predetermined pixel number within the 1H line is sampled, it can been seen that the phase difference is maintained.

There are some cases that as indicated in FIG. 3D, for instance, "α" pieces of pixels larger than the predetermined pixel number within the 1H line are sampled. The 1-H judging unit 22 supplies both the judgment result 12*f* and the difference 12*g* of the pixel numbers to the write control unit 24. Since the horizontal sync signal is delivered with a delay of "α" pixels, the phase difference is decreased by this delay time (n/2−α). Since there is a higher possibility that the extra "α" pieces of pixels are located outside the display area of the screen, the write control unit 24 immediately advances to execute the write control process operation for the next line without executing the write control process operation as to this input data in order that the read control operation may be carried out in the normal manner. In other words, as the process operations of the write control unit 24, since "α" pieces of write addresses are not increased as compared with such a process operation that all of the input data 16*a* are written, the process operation for the next line is carried out, so that the arrival of the final pixel under the write control operation can become earlier. This packing of the write address is expressed by an arrow "A".

In the read control operation, the written input data 16*a* are simply and sequentially read out. At this time, the written input data 16*a* are quickly and eventually read by such a time during the read control operation. This time is expressed by a product calculated by the "α" pieces and the sampling clock period by way of the packing process operation for the "α" pieces of write addresses during the writing operation. As previously explained, a phase difference in this case becomes "n/2−α" due to the relationship between FIG. 3D and FIG. 3F with respect to the normal relationship of phase difference "n/2". Subsequently, it is understood that even if the input data 16*a* is not correctly supplied decreased phase difference is maintained. During the read control operation, a preselected number of pixels are read out, so that an equivalent process operation to the normal read control operation may be carried out.

Conversely, as shown in FIG. 3G, there is a certain possibility that "α" pieces of pixels smaller than the preselected number of pixels within the 1H line are sampled. In the 1-H judging unit 22, both the judgment result 12*f* and the difference 12*g* of the pixel number are supplied to the write control unit 24. In this case, in the write control unit 24, since the supply of the judgment result 12*f* is received, it is so assumed that a final pixel within a 1H line is delivered; write addresses corresponding to the difference 12*g* of the pixel numbers are counted, and further, such a write control signal 14*c* is produced in such a manner that the outputs of the write addresses are stopped, or prohibited during this address counting operation, and then, this write control signal 14*c* is supplied to the write counter 24*b*. Since the commencement of the writing operation in the 1H line is hastened by the "α" pieces of pixels, a phase difference is increased by (n/2+α). As a result, as to the write address, since the write control operation for the next line is immediately carried out from the final pixel, the write addresses corresponding to the "α" pieces of pixels are skipped. This write address skipping process operation is expressed by another arrow "B" indicated between FIG. 3G and FIG. 3H.

In the read control unit 28, the read control operation with respect to the FIFO memory 26 is carried out in the normal manner. At this time, as to the phase difference, such a relationship of (n/2+α) is maintained. Under read control operation, the write addresses to which the skipping address process operation has been carried out are used as read address. However, the pixel data before the 1H line having the smaller sampling pixels had been written has been written in the write addresses of the FIFO memory 26 to which the skipping process operation has been carried out. The input data that has already been written into this shortage area may not always have a good correlative characteristic with respect to the present 1H line. Since the read control unit 28 reads out such a data having no relationship with present line, flickering noise may be produced at edges on the display screen.

To the contrary, in accordance with this embodiment, the 1-H judging unit 12 supplies both the judgment result 12*f* and the difference 12*g* of the pixel numbers to the write control unit 14, and supplies the difference 12*g* of the pixel number to the register 18*c*. Upon receipt of both the judgment result 12*f* and the difference 12*g* of the pixel numbers, the write control circuit 14*a* employed in the write control unit 14 judges that the final pixel can be detected, and outputs the data write enable signal 14*e* to the register 18*c*. While the write address 14*f* is supplied from the write counter 14*b* to the register 18*c*, when the data write enable signal 14*e* indicative of the enable state is supplied to this register 18*c*, this register 18*c* fetches a write address to the supplied. Also, the register 18*c* also stores threinto the difference 12*g* of the pixel numbers. The data read enable signal 18*i* is supplied from the read adjusting circuit 18*d* to the register 18*c*, and subsequently, this register 18*c* outputs the stored write address as a read address 18*j* to both the read adjusting circuit 18*d* and the selection circuit 18*e* in response to the sampling clock 12*c*.

Both the read address 18*g* derived from the read counter 18*b* and the above-explained read address 18*j* are supplied to the read adjusting circuit 18*d*, and then, these address values are compared with each other. The read adjusting circuit 18*d* produces such a selection control signal 18*n* in such a manner that the read address 18*j* derived from the input terminal 18*k* is selected during a time period which is fitted to the magnitude of the difference 12*g* of the pixel numbers in response to a coincidence of the compared address values. Upon receipt of the selection control signal 18*n*, the selection circuit 18*e* sends the read address of the final pixel to the FIFO memory 16 for such a time period during which there is no pixel after the final pixel, or there is a shortage of pixels after the final pixel. In response to the supplied read address, input data 18F of a final pixel indicated in FIG. 3H is repeatedly read out from the FIFO memory 16. This input data 18F corresponds to the data of the present line, and may be conceived as the same data as a shortage of input data that should be originally sampled, or such an input data similar thereto.

As a consequence, since the input data 18F is read out, when the pixel timing adjusting apparatus 10 supplies a pixel having an equivalent level to a monitor (not shown), this pixel timing adjusting apparatus 10 can avoid that the flickering noise is produced on the display screen corresponding to the pixel shortage area. The phase difference becomes ($n/2+\alpha$) when this phase difference is expressed in the unit of the pixel number due to a shortage of "$\alpha$" pixels. If there are either the increased pixels or the shortage of pixels in the 1H line, then it can be seen that the phase difference is changed from the timing chart of FIG. 3. The change of the phase difference may be reset while the field is employed as the unit.

As apparent from the foregoing descriptions, in the case that a count value judged by the 1-H judging unit 12 is made coincident with the standard value (858), or is larger than this standard value (858), since the same process operation executed in the pixel timing adjusting apparatus 20 is performed, there is no problem in the image processing operation. Also, in the case that the 1-H judging unit 12 judges that a count value is smaller than the standard value (858), the difference 12*g* of the pixel numbers is substantially equal to either "1" or "2", but never becomes larger than these values under normal condition.

Since the pixel timing adjusting apparatus 10 is operated in the above-described manner, even when the total pixel number per 1 line becomes small, the occurrence of the flickering noise can be avoided, so that the pixel timing adjusting apparatus 10 can provide the pictures having the higher image qualities.

Figure 4:
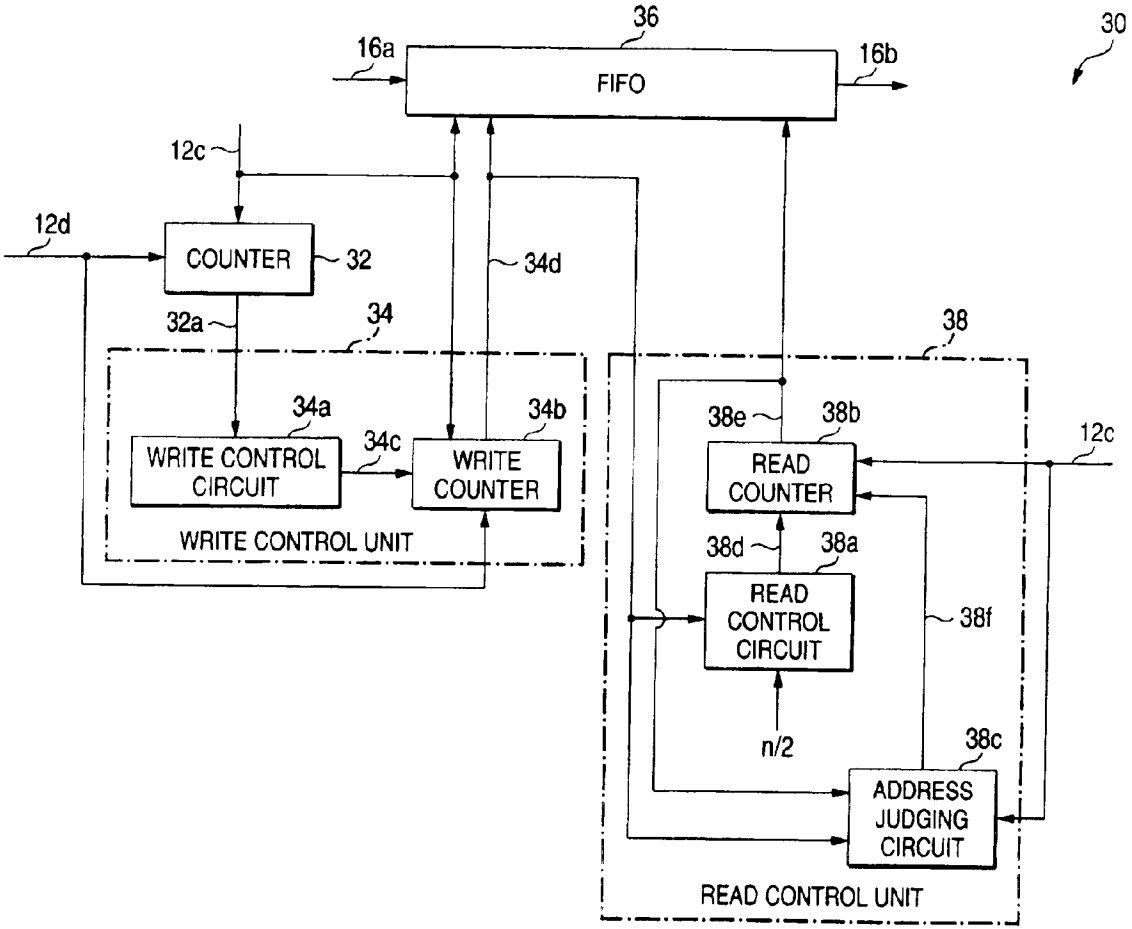
FIG. 4 is a block diagram for schematically representing an arrangement of a pixel timing adjusting apparatus to which another arrangement of the image processing apparatus according to the present invention is applied.

Next, a description will now be made of another pixel timing adjusting apparatus 30 to which the image processing apparatus of the present invention is applied according to another embodiment with reference to FIG. 4. In this embodiment, the following phenomenon can be prevented. That is, in this phenomenon, while a deviation from the standard value in a pixel number to be sampled is stored in a phase difference, such a display screen is observed in which an upper portion of this display screen is shifted from a lower portion, and a disturbance occurred in a half way of the display screen is continued until this relevant field is ended. In the previous embodiment, the memory capacity of the FIFO memory 16 is made smaller than the pixel number of the standard value. In this case, the register 18*c*, the read adjusting circuit 18*d*, and the selection circuit 18*e* are provided in the read control unit 18 so as to perform the read control operation, so that the flickering noise appeared in the pictures may be prevented.

The pixel timing adjusting apparatus 30 contains a counter 32, a write control unit 34, a FIFO memory 36, and a read control unit 38. Briefly comparing with the arrangement of the previous embodiment, this pixel timing adjusting apparatus 30 owns such a different structural difference. That is, the 1-H judging unit 12 is not provided, but only the counter 32 is arranged, and as will be explained later, the write control unit 34 judges a total pixel number within a 1H line. Also, in this pixel timing adjusting apparatus 30, the same reference numerals used in the above-described embodiment will be employed as those for denoting the same signals.

The counter 32 counts pixel values larger than the standard values (858) for sampling the 1H line by the sampling clock 12*c*. A horizontal sync signal 12*d* is supplied as a reset signal to the counter 32. The counter 32 outputs a count value 32*a* sampled within the 1H line to the write control unit 34.

Both a write control circuit 34*a* and a write counter 34*b* are arranged in the write control unit 34. When the count value 32 is supplied from the counter 32, the write control circuit 34*a* immediately supplies a write control signal 34*c* indicative of a commencement of a counting operation to the write counter 34*b*.

Alternatively, the write control circuit 34*a* may compare the supplied count value 32*a* with the standard value (858) so as to judge a size of a 1H line, and thus, may control the write counter 34*b*.

The write counter 34*b* can count pixel numbers larger than, or equal to a 1H line in a similar manner to the counter 32. Also, the horizontal sync signal 12*d* is supplied as a reset signal to the counter 34*b*. As a result, the write counter 34*b* resets the write address 34*d* every 1H line. The write counter 34*b* supplies the write address 34*d* to both the FIFO memory 36 and the read control unit 38.

The FIFO memory 36 owns a memory capacity similar to, or higher than the memory capacity of the previous embodiment. In this embodiment, such a memory capable of storing pixel numbers larger than, or equal to the pixel numbers of the 1H line. The FIFO memory 36 stores thereinto the input data 16*a* in accordance with the sequence in response to the write address 34*d*, and then, reads out the stored input data 16*a* as output data 16*b* in accordance with the sequence in response to a read address (will be discussed later). The FIFO memory 36 owns such a different point. That is, although the write data amount of the previous embodiment is not restricted, a write data amount of this FIFO memory 36 is basically defined to a 1H line.

The read control unit 38 is provided with a read control circuit 38*a*, a read counter 38*b*, and an address judging circuit 38*c*. The read control circuit 38*a* detects first starting timing in the read counting operation, and outputs a counter control signal 38*d* to the read counter 38*b*. A half value ($n/2$) of the memory capacity "n" of the FIFO memory 36 has been previously supplied as a phase difference to the read control circuit 38*a*. After the write address 34*d* is once supplied from the write counter 34*b* to the read control circuit 38*a*, this read control circuit 38*a* commences the counting operation. When this count value is reached to the value of the phase difference, the read control circuit 38*a* outputs the counter control signal 38*d* as the first starting timing.

The read counter 38*b* corresponds to a pixel counter that counts the standard pixel number. As a result, such a reset signal which is supplied every 1H line is no longer required for the read counter 38*b*. In response to the sampling clock 12*c* that is reset-supplied every 1H line in the read control operation, the read counter 38*b* performs the counting operation, and then, supplies a read address 38*e* to the address judging circuit 38*c*.

It should also be noted that when the FIFO memory 36 owns such a memory capacity larger than, or equal to the standard value of the 1H line, as to both the write counter 34*b* and the read counter 38*b*, while a counter having a pixel number corresponding to a memory capacity is prepared, a standard counter (not shown) for counting the standard value may be prepared. Also, the standard value counter commences its counting operation in response to the supply of the counter control signal 38*d*, and while this standard counter executes a loop counting operation of the standard value, this standard counter reads out a reset signal every count of the standard value indicative of the 1H, and then outputs this reset signal to the counter 38*b*. As a consequence, similar to the above-described case, the read address 38*e* may be loop-counted every standard value.

The address judging circuit 38*c* judges as to whether or not the write address 34*d* supplied to the FIFO memory 36 is made coincident with the read address 38*e*, and outputs an output prohibit signal 38*f* to the read counter 38*b* in response to a coincidence of these compared addresses. When this coincident read address 38*e* is supplied to the FIFO memory 36, there is such a risk that the input data 16*a* supplied in connection with the write address 34*d* is destroyed. Therefore, this output prohibit signal 38*f* is supplied in such a manner that after the input data 16*a* has been written by setting the write address 34*d* with a top priority, the prohibition of the output is released. The read counter 38*b* restarts the supply of the read address 38*e* since the output prohibit signal 38*f* is released. As a result, the read address 38*e* to be supplied is outputted in such a manner that a value different from the value of the write address 34*d* is shifted. From the FIFO memory 36, the input data that is not destroyed is read as output data in response to the address shift.

Figure 5:
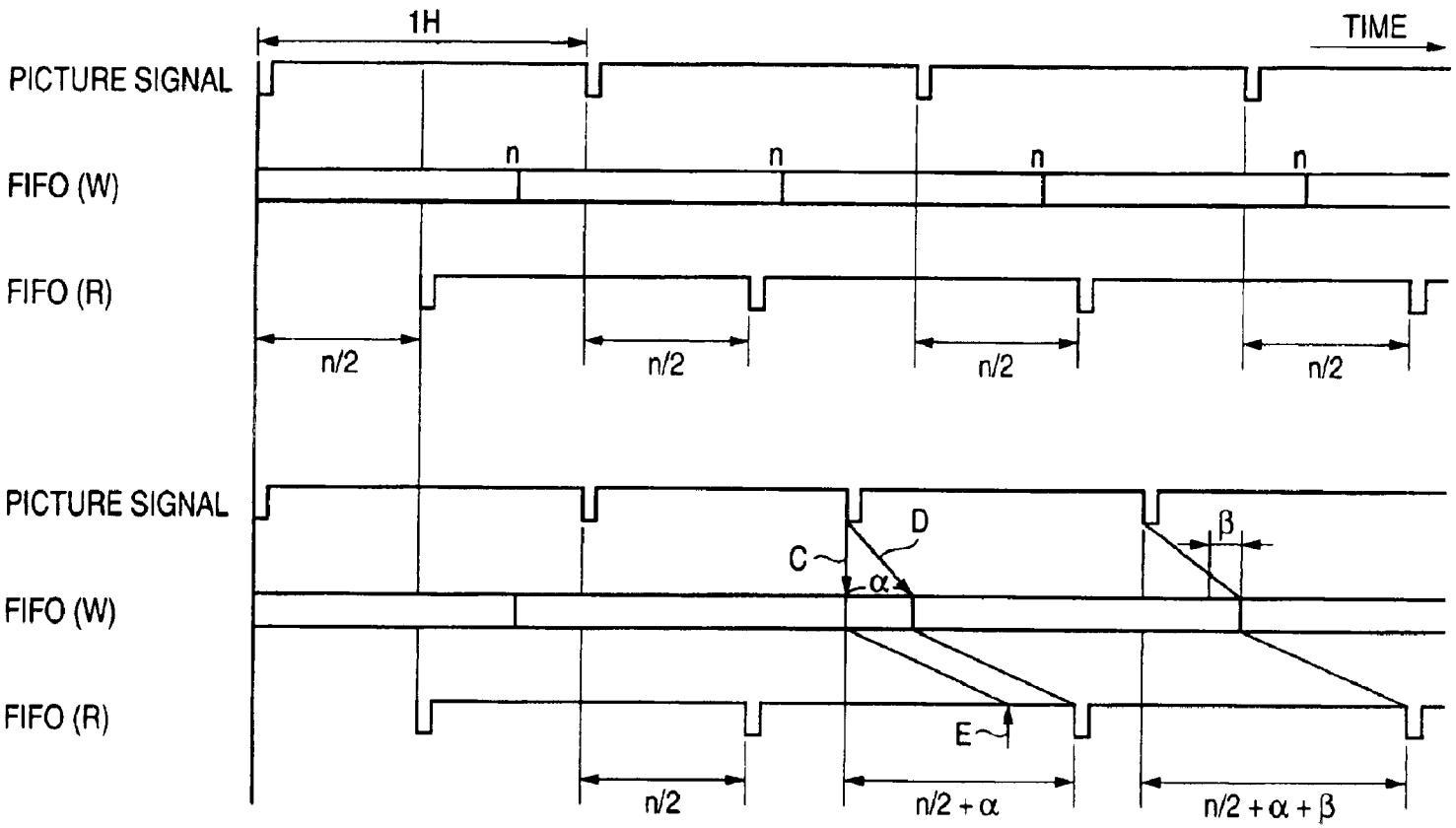
FIG. 5 is a timing chart for explaining controlling operations of a FIFO memory employed in the pixel timing adjusting apparatus shown in FIG. 4.

Referring to a timing chart of FIG. 5, operations of the pixel timing adjusting apparatus 30 will now be explained. The timing chart of FIG. 5 represents: such a case (FIGS. 5A, 5B and 5C) that a predetermined pixel number in a 1H line is sampled; and such a case (FIGS. 5D, 5E, and 5F) that pixel numbers smaller than a predetermined pixel number are sampled, respectively. In this case, a memory capacity "n" corresponding to a predetermined pixel number (858) in an 1H line as shown in FIG. 5B is employed as the FIFO memory 36. A phase difference is set to a half value (n/2) of the memory capacity "n" in accordance with the above-described definition. As shown in FIG. 5A to FIG. 5C, a predetermined pixel number is supplied as input data 16*a*, and when output data 16*b* is read out, it can be seen that the phase difference of "n/2" is maintained.

In contrast to the above case, when the sampling number (pixel number) of the input data 16*a* is smaller than the predetermined pixel number, the pixel timing adjusting apparatus 30 does not consider either the pixel number indicated by the standard value or the pixel number indicated by the non-standard value by merely performing the write control operation by the write control signal 34*c* indicative of the count starting operation in the write control unit 34. It is important for the write control unit 34 that the input data for the 1H line is written under the write control operation, and since the horizontal sync signal 12*d* is supplied to the write control unit 34, the writing operation for the 1H line is accomplished and, at the same time, the write address is reset. As a consequence, even when the pixel number is smaller than the standard pixel number of the 1H line, the write control unit 34 forcibly commences the write control operation in the next line. This corresponds to such a write skipping process operation that either a difference in pixel numbers or a shortage of pixel number "α" indicated by arrows "C" and "D" of FIG. 5D and FIG. 5E is set.

Next, since the read counter 38*b* for counting the standard pixel number is employed in the read control unit 38, counting of the read address 38*e* is looped at the standard value. Under the read control operation, after the reading operation has commenced, the read address 38*e* in combination with the above-described loop counting operation is supplied to the FIFO memory 36. In the case that, for example, "α" pieces of pixels are smaller than the standard value of the 1H line, the reading operation in this line is ended at a position of an arrow "E". As a consequence, "α" pieces of pixels defined from the position (address) of the arrow "E" up to a read starting position (address) in a next line are empty-read, namely no data is read. However, such a phenomenon that edges of a picture are flickered in connection with this empty-reading does not occur.

The pixel timing adjusting apparatus 30 executes such a write control operation without using the conceptional idea of the above-described phase difference, and executes such a read control operation that the standard pixel number is employed as the count reference, and thus, accesses to the FIFO memory 36 so as to adjust input/output operations of the picture signal. In an actual case, as to the relationship of this control operation, when the input data 16*a* smaller than the standard pixel number is supplied, as apparent from the definition of the phase difference, the phase difference is increased. In the case that "α" pieces of pixels are smaller than the standard pixel number, the phase difference is expressed as (n/2+α) in the unit of quantity. Furthermore, assuming now that the input data 16*a* smaller than the standard pixel number of the 1H line also in the next line by "62 " is entered, the phase difference becomes (n/2+α+β). As explained above, the phase differences are stored.

On the other hand, as a result of such a condition that a read address is shifted to be stored with respect to a write address, there are some possibilities that both the read address and the write address are made coincident with each other. Since the input data of the write address is probably destroyed, if the write address is made coincident with the read address, then the write control operation is carried out at a top priority. Therefore, the address judging circuit 38*c* of the read control unit 38 detects the coincidence between the read/write addresses, and outputs an output prohibit signal 38*f* to the read counter 38*b*. The read counter 38*b* prohibits the counting process operation of the read address 38*e* and does not output the read address. Upon receipt of a prohibition releasing instruction of the output prohibit signal 38*f*, the read counter 38*b* restarts the counting operation. As a consequence, a read address produced when the counting operation is restarted owns such an address value delayed by 1 with respect to the relevant write address.

As previously explained, while the collisions of the addresses and skipping operations of the read addresses with respect to the write addresses are avoided, since the FIFO memory 36 is accessed, the pixel number per 1H line can be managed. Since the write resetting operation is carried out every line, even when the line partially fails in a half way of the display screen, only a failure portion of this line is restricted. As a result, the pictures having the better image qualities and no flickering phenomenon can be provided, as compared with the line failure of the prior art.

Figure 6:
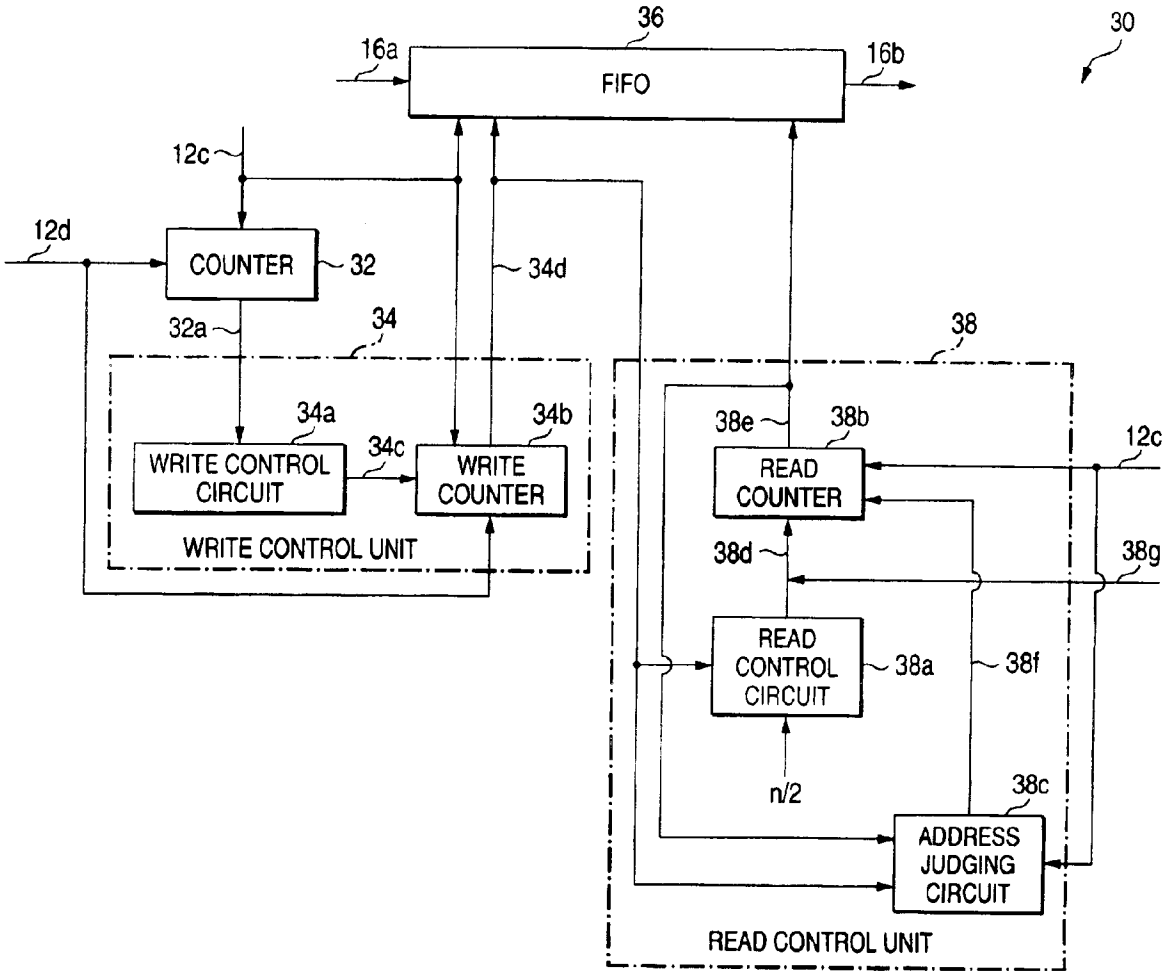
FIG. 6 is a block diagram for schematically indicating an arrangement of a first modification as to the pixel timing adjusting apparatus of FIG. 4.

Next, a description will now be made of an arrangement of a first modification related to the pixel timing adjusting apparatus 30 with reference to FIG. 6. It should be understood that in he above-described embodiment, since the read control unit 38 is operated in the free mode, if the standard signal is not employed, as explained above, then the following case may occur. That is, the write address is made coincident with the read address. This address coincident condition may stop, or interrupt the reading operation, so that this address coincidence may constitute a discontinuous point of operations. Also, since a phase difference equal to a time difference between write starting time and read starting time is not managed, the output data 16*b* will be fluctuated due to delays caused by the magnitudes of the phase differences. In the first modification, while the arrangement of the above-described embodiment is employed, a vertical sync signal 38*g* is supplied to the read control unit 38 as indicated in FIG. 6. Although a vertical sync signal 38*g* is not shown in this drawing, a vertical sync signal is detected from a picture signal supplied in this sync separation process circuit, and then is sync-separated, so that this vertical sync signal 38*g* is supplied.

The read counter 38*b* continuously performs the loop counting operation of the standard pixel value as to the pixel number in the 1H line. When the vertical sync signal 38*g* is supplied to the read counter 38*b*, this read counter 38*b* resets the read counting operation. Since the read counting operation is reset, the phase difference stored every 1 field is cleared. As a result, the coincidence between the write address and the read address that has occurred in the above-described embodiment can hardly occur, and thus, the occurrence of the discontinuous point can be suppressed. Also, since this vertical sync signal 38*g* is supplied the read counter 38*b*, both the write control operation and the read control operation are managed in the unit of 1 field, the fluctuation produced between the input data and the output data can hardly occur. In the case that the vertical sync signal 38*g* is supplied, the address judging circuit 38*c* of FIG. 6 need not be employed.

It should be noted that as to the address judgment, the discontinuous point may be monitored/controlled, if necessary. As a consequence, the arrangement may be made simpler and the pictures having the higher image qualities may be provided.

Figure 7:
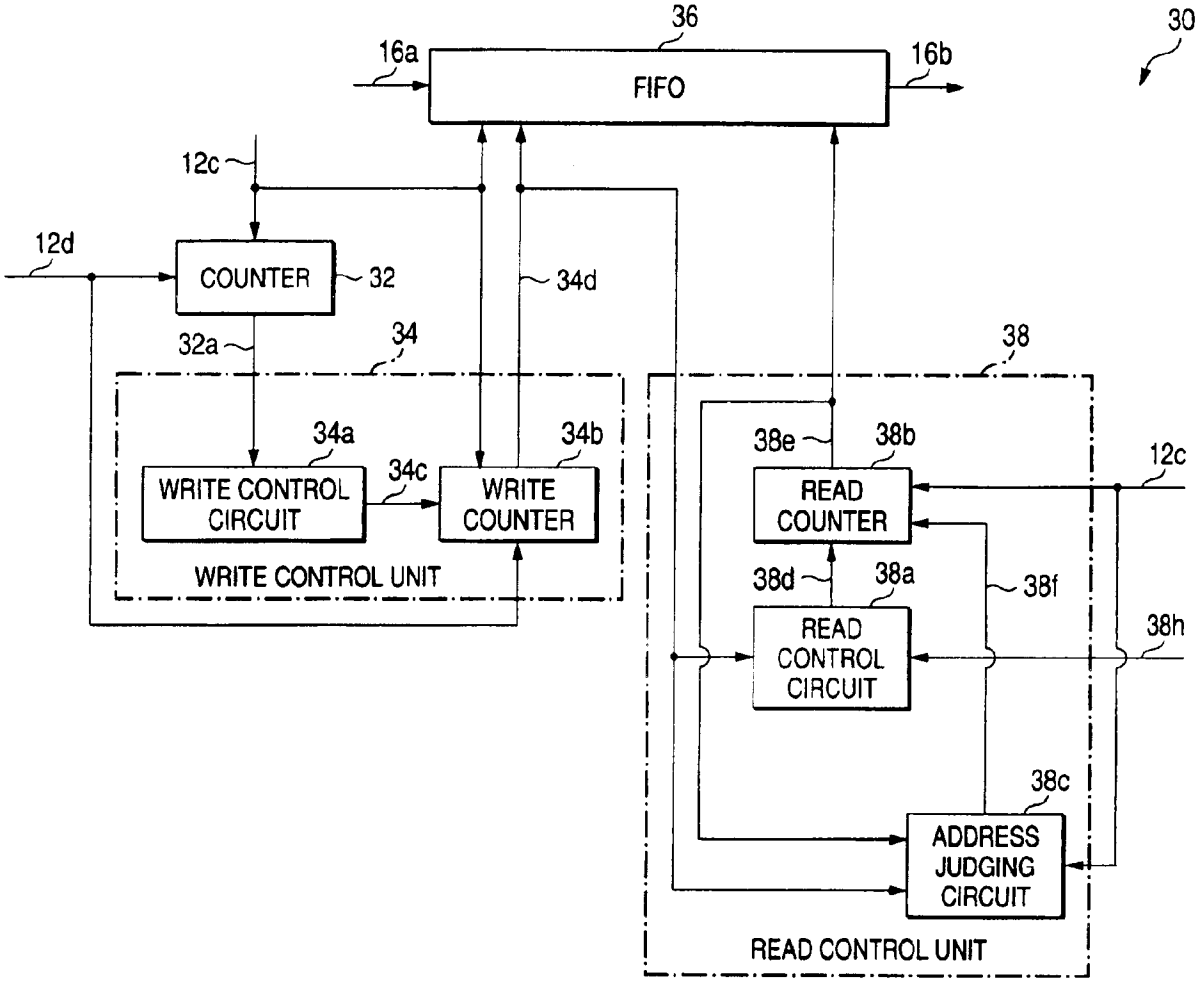
FIG. 7 is a block diagram for schematically showing an arrangement of a second modification as to the pixel timing adjusting apparatus of FIG. 4.

Referring now to FIG. 7, an arrangement of a second modification as to the pixel timing adjusting apparatus 30 will be explained. Various sorts of picture signals such as the standard signal of the NTSC specification and the non-standard signal are supplied to the pixel timing adjusting apparatus 30. The pixel timing adjusting apparatus 30 adjusts are setting position during a reading operation based upon a sort of an inputted picture signal in order to improve a picture quality when the output data 16*b* is displayed. In particular, when such a picture signal derived from an analog VTR (Video Tape Recorder) having a deteriorated quality, or an analog TV (Television-set) having a deteriorated quality is continuously read at constant timing, and is reset by the vertical sync signal 38*g*, there are some possibilities that out-of-synchronization may instantaneously occur.

In the second modification, in addition to the arrangement of the above-described embodiment shown in FIG. 5, an adjusting reset signal 38*h* is manually supplied from an external unit to the read control circuit 38*a* of the read control unit 38. While a phase difference "n/2" has been previously stored in the read control circuit 38*a*, a time elapse of the phase difference "n/2" is detected by employing a supplied write count 34*d*, and then, a counter control signal 38*d* for instructing a commencement of the reading operation is outputted to the read counter 38*b*. Also, the read control circuit 38*a* outputs the adjusting reset signal 38*h* supplied from the external unit as the counter control signal 38*d*. Since the timing of the vertical sync signal for resetting the read address 38*e* is not constant, the reset timing in the read counter 38*b* is changed, and therefore, the adjusting reset signal 38*h* is required.

For example, as to either the standard signal of the NTSC specification or a signal approximated to this NTSC standard signal, which are outputted from a signal generator or the like (not shown), a total number of pixels per 1H line is constant. The adjusting reset signal 38*h* for such a picture signal sets the reset timing of the read counter 38*b* just after an effective line of a field in the input data 16*a* is ended. As a consequence, the pixel timing adjusting apparatus 30 can obtain such a picture that the pixel numbers per 1H line are managed without giving any adverse influence to the picture produced by the output data 16*b*.

To the contrary, as to a picture signal whose pixel number per 1H line is not constant and whose picture quality is deteriorated, for example, a picture signal derived from a VTR, a vertical sync position is not also determined. As a consequence, even when the resetting position is set just before the effective line of the field, the actual resetting position would be shifted to such a position that is changed from the resetting position that has been set. If the read resetting operation is continued at the constant resetting position as in the first modification, there are some possibilities that the synchronization of the picture is no longer maintained. In such a case, the adjusting reset signal 38*h* is provided in such a way that a position within an effective pixel is provided as a position of reset timing. This reason is given as follows. That is, if the resetting operation is carried out at this timing (position) even when this reset timing is more or less overlapped with the effective pixel, then the picture may be stabilized. In this case, even when the reset timing is overlapped with the effective pixel, this position is a lower portion of the picture, namely the picture portion whose image quality is originally deteriorated. Therefore, this lower picture portion is not specifically considered, and is located outside a display range in a TV set and the like.

As previously explained, resetting operation in the reading control is omitted, and the adjusting reset signal 38*h* is supplied from the external unit so as to vary the resetting position, depending upon the sort and the characteristic of the inputted picture signal. As a result, the pixel timing adjusting apparatus of the second modification can improve the image qualities of the picture signals produced by the output data 16*b* even as to any pictures.

Next, a description will now be made of an arrangement of a third modification related to the pixel timing adjusting apparatus 30 with reference to FIG. 8. It should be understood that the pixel timing adjusting apparatus 30 of this third modification owns such a feature that a read control unit 38 thereof is different from the read control unit 38 among the structural elements of FIG. 4. This read control unit 38 contains a timing control unit 38A, a read counter 38*b*, and a phase difference judging circuit 38*i*. The timing control unit 38A owns such a function for supplying timing signals by which a reading operation is commenced and a counter resetting operation is performed with respect to the read counter 38*b*. This timing control unit 38A contains a read control circuit 38*a* and an OR gate 38*j*.

As previously explained, the read control circuit 38*a* detects a time elapse of a phase difference "n/2", and produces a counter control signal 38*d* to supply this produced counter control signal 38*d* to the OR gate 38*j*. The counter control signal 38*d* notifies the commencement of the reading operation to the read counter 38*b* in response to this detection. The OR gate 38*j* OR-gates the three supplied signals, namely, the counter control signal 38*d*, the phase difference judgment signal 38*k* derived from the phase difference judging circuit 38*i*, and the vertical sync signal 38*g*, so that this OR gate 38*j* produces a synthetic counter control signal 38D and then supplies this synthetic counter signal 38D to the read counter 38*b*.

The read counter 38*e* corresponds to such a counter for loop-counting the standard value, and commences the counting operation in response to timing of the counter control signal 38*d* supplied from the read control circuit 38*a*. The read counter 38*b* supplies a read address 38*e* that is outputted in response to the sampling clock 12*c* to both the FIFO memory 36 and the phase difference judging circuit 38*i*, respectively.

The phase difference judging circuit 38*i* owns such a function that while the firstly-set phase difference "n/2" is employed as the reference, an allowable range of the phase difference is set by a threshold value, and a judgment is made as to whether or not a phase difference during operation exceeds this set threshold value. As previously explained, with respect to the phase difference, the firstly-set phase difference "n/2" in 1H line is increased and/or decreased in accordance with a difference in pixel numbers in which the sampled pixel number is increased and/or decreased with respect to the standard value, and then this difference obtained every line is stored in the phase difference. This fact has already been explained with reference to both the timing chart of FIG. 3 and the timing chart of FIG. 5.

In the case that the present phase difference which has been stored exceeds the set threshold value, the phase difference judging circuit 38*i* outputs a phase difference judging signal 38*k* to the OR gate 38*j* in such a manner that the counting operation for the read counter 38*b* is reset. The sampling clock 12*c* is also supplied to the phase judging circuit 38*i* and this phase judging circuit 38*i* is operated in response to this sampling clock 12*c*.

It should be noted that while both the threshold value and the phase difference may be handled as absolute values during judgment, the judging operation may be carried out.

Next, operations of the pixel timing adjusting apparatus 30 according to the third modification will now be described. In order to avoid cumbersome and repetitive explanations of this pixel timing adjusting apparatus 30, only different operations thereof from those of the previous modifications will be explained. In the above-described second modification, the pixel management has been effectively carried out irrespective of the sort/image quality of the entered picture. This management method is carried out in the manual manner by switching the externally-supplied control signal. However, it is difficult to control the pixel management in such a system that sorts of input signals and qualities of these input signals are frequently changed.

The pixel timing adjusting apparatus 30 of this third modification is provided with a function capable of performing a resetting operation in response to a judgment result obtained in the phase difference judging circuit 38*i* with respect to the second modification. The synthetic counter control signal 38D may provide both a commencement of the read counting operation and reset timing of the read counter 38*b* via the OR gate 38*j*, while not only the counter control signal 38*d* and the vertical sync signal 38*g*, but also the phase difference judging signal 38*k* are considered.

In such a case that a difference between the write address 34*d* and the read address 38*e* which are supplied to the phase difference judging circuit 38*i* is larger than a threshold value, this phase difference judging circuit 38*i* judges that the entered picture signal corresponds to either the non-standard signal or the picture signal having the deteriorated image quality. However, this judged condition may be a certain possibility that this condition occurs just after the picture signal is changed from the non-standard signal to the standard signal. In the phase difference judging circuit 38*i* of this third modification, this possibility is neglected, and the phase difference judging signal 38*k* is supplied to the read counter 38*b* under this condition. As a result, since the read counter 38*b* is reset, an initial phase difference is set to "n/2" in the next line. In other words, this implies that the initial phase difference is returned to a center position within a range of such a phase difference indicated by the threshold value.

As a consequence, the phase difference judging circuit 38*i* can judge that the input data of the next line is the standard signal. As a result, the reset timing provided by the phase difference judging signal 38*k* is not limited to such a reset position of the vertical sync signal 38*g* which is provided at the constant timing, but such a position which is defined in response to a magnitude of a phase difference may be set to the reset position.

Even when the pixel timing adjusting apparatus 30 is operated in the above-described manner, the high-performance following operation thereof can be automatically carried out with respect also to be changes in the sorts of picture signals to be inputted. As a consequence, even when any sorts of picture signals are inputted, the pictures having the better image qualities can be simply obtained by adjusting the timing.

Finally, a description will now be made of an arrangement of a fourth modification related to the pixel timing adjusting apparatus 30 with reference to FIG. 9. It should be understood that the pixel timing adjusting apparatus 30 of this fourth modification owns such a process operation that judgment precision of pixel managing operation is increased which is automatically carried out in an effective manner irrespective of sorts/image qualities of picture signals executed in the third modification, and thus, superior output data 16*b* can be obtained from a FIFO memory 36.

Figure 8:
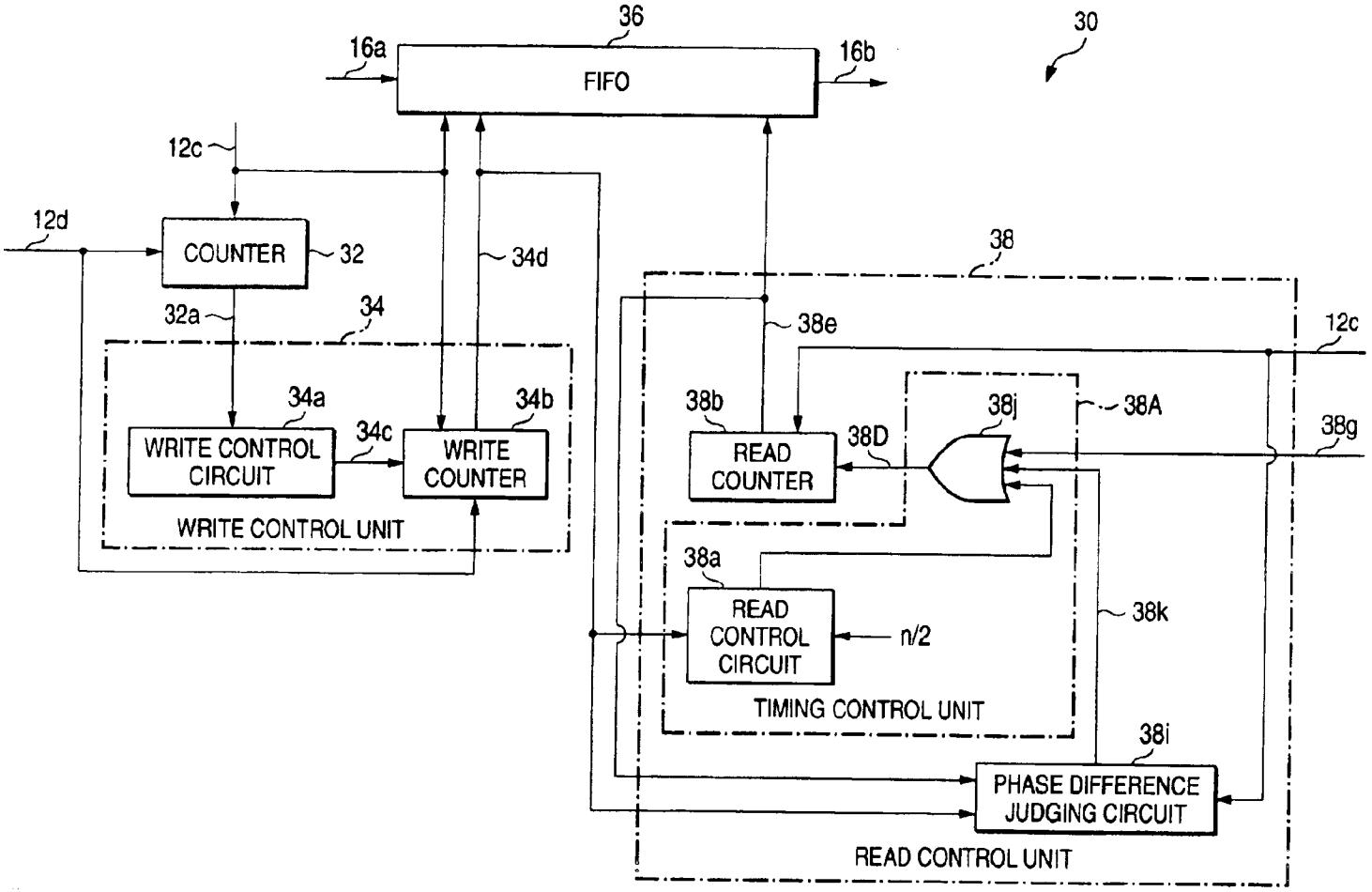
FIG. 8 is a block diagram for schematically indicating an arrangement of a third modification as to the pixel timing adjusting apparatus of FIG. 4.

The pixel timing adjusting apparatus 30 of this fourth modification is provided with the same structural elements as those of FIG. 8, namely, is equipped with a counter 32, a write control unit 34, the FIFO memory 36, and a read control unit 38. With respect to the counter 32, the write control unit 34, the FIFO memory 36, and both a read counter 38*b* and a phase difference judging circuit 38*i* of the read control unit 38, since the same explanations thereof are repeatedly made, these explanations are omitted. An attention point paid to a different structure from that of FIG. 8 is a structure of a timing control unit 38A.

Figure 9:
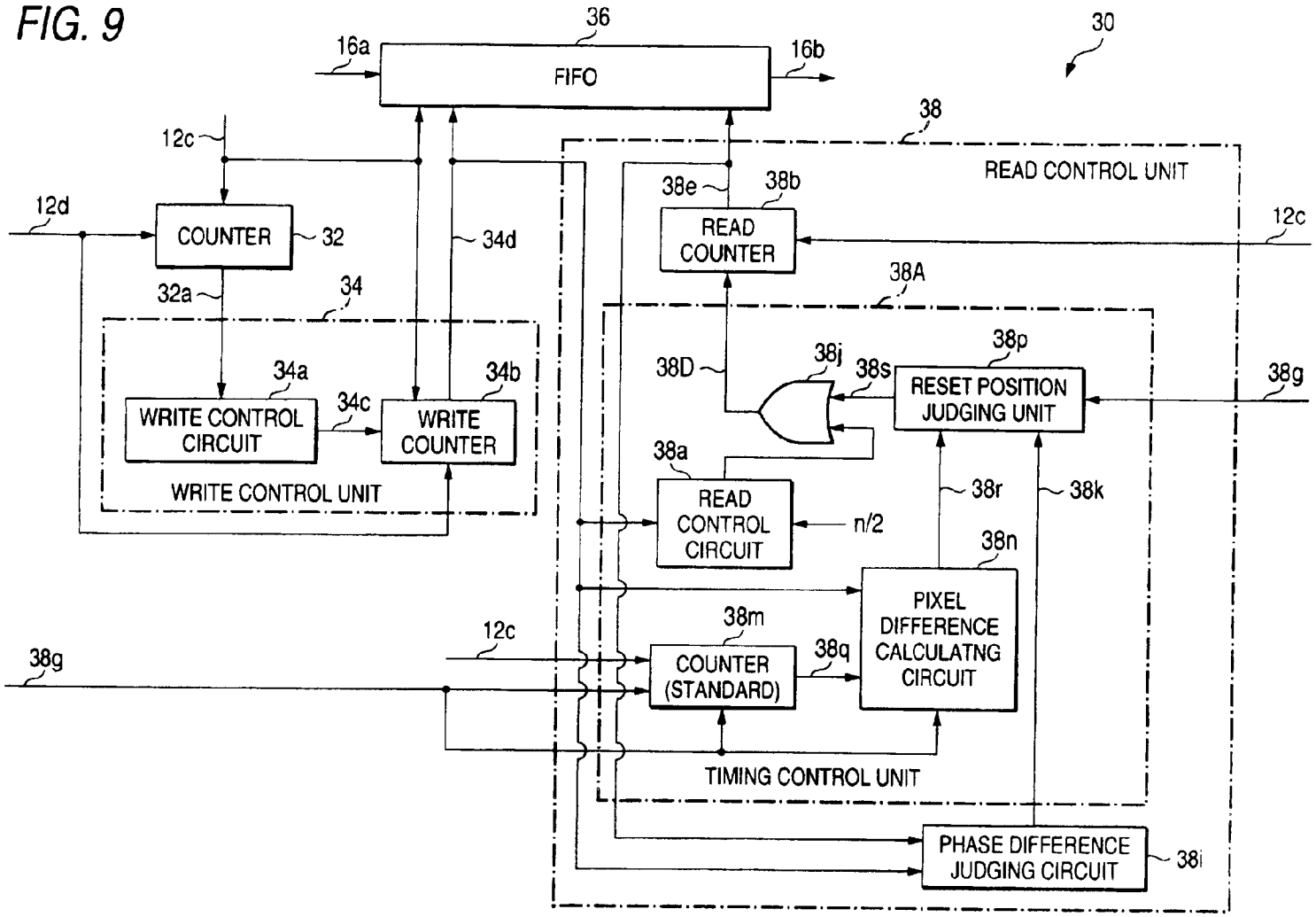
FIG. 9 is a block diagram for schematically showing an arrangement of a fourth modification as to the pixel timing adjusting apparatus of FIG. 4.

As indicated in FIG. 9, the timing control unit 38A contains both a read control unit 38*a* and an OR gate 38*j*, and furthermore, a counter 38*m*, a pixel difference calculating circuit 38*n*, and a reset position judging unit 38*p*. The counter 38*m* performs a loop counting operation of the standard value by employing the sampling clock 12*a*, and is reset by receiving a vertical sync signal 38*g*. Although not shown in this drawing, a counter control signal 38*d* is supplied to the counter 38*m* as a trigger signal that commences a counting operation of a first counter. The counter 38*m* outputs a count value 38*q* to the pixel difference calculating circuit 38*n*.

The pixel difference calculating circuit 38*n* owns such a function. That is, this pixel difference calculating circuit 38*n* calculates a difference in essential pixel numbers within the present line, which is produced between a count value indicated by a write address 34*d* and the count value 38*q* of the standard value which is supplied by being shifted by a phase difference "n/2", and then, stores thereinto this calculated difference in the pixel numbers. The pixel difference calculating circuit 38*n* reads such a difference of essential pixel numbers which has already been stored and has been calculated with respect to one-preceding 1H line, and calculates a shift amount 38*r* of a 1H pixel number based upon a difference between the difference contained in the essential pixel numbers of the present line and the difference contained in the essential pixel numbers of one-preceding 1H line, and thereafter, transfers this shift amount 38*r* to the reset position judging unit 38*p*. The difference in the essential pixel numbers is such a value obtained by subtracting the phase difference "n/2" from the difference between both the count values, and corresponds to an accumulated pixel number to which produced increases/decreases of sampling pixels within a 1H line is considered. The vertical sync signal 38*g* is supplied to the pixel difference calculating circuit 38*n*. As a consequence, the pixel difference calculating circuit 38*n* calculates the shift amount 38*r* of the pixel numbers, which is produced within the 1H line, and is reset at the timing of the vertical synchronization.

The reset position judging unit 38*p* judges a resetting position based upon the shift amount 38*r* of the pixel numbers, the phase difference judging signal 38*k*, and the vertical sync signal 38*g*, and then outputs a reset timing signal 38*s* in accordance with this judgment result to the OR gate 38*j*. It should be noted that judging conditions of the resetting position will be explained in the below-mentioned operations.

The OR gate 38*j* supplies such a signal as a synthetic counter control signal 38D to the read counter 38*b*, while this signal is obtained by OR-gating the counter control signal 38*d* and the reset timing signal 38*s*.

A description is made of operations of the read control unit 38. For example, in the phase difference judging circuit 38*i*, the judging operation is commenced by that the phase difference is "n/2" in the beginning, and the phase difference judging signal 38*k* is supplied to the reset position judging unit 38*p*. In the case that the phase difference contained in the phase difference judging signal 38*k* supplied from the phase difference judging circuit 38*i* is equal to a value of "0", or an absolute value thereof is small, the reset position judging unit 38*p* judges that the inputted picture signal corresponds to such a picture signal having a better image quality of either the standard value or a value approximated to this standard value. The reset position judging unit 38*p* supplies the reset timing signal 38*s* during the reading operation in accordance with this judging operation, and inserts this reset timing signal 38*s* just after an effective line of the input signal. Since the resetting operation is performed in this reset position judging unit 38*p*, such an image having a high image quality and having no adverse influence may be outputted from the FIFO memory 36 to a picture display unit (not shown).

To the contrary, when a phase difference contained in the phase difference judging signal 38*k* supplied from the phase difference judging circuit 38*i* is large, a total pixel number of an input signal is largely different from the standard value, so that the reset position judging unit 38*p* may predict that a picture signal to be inputted corresponds to either a non-standard signal or a signal having a deteriorated image quality. As a result, as previously explained, even in such a case that an effective pixel area of the picture signal is more or less sacrificed, since the read address 38*e* is reset within the effective pixel area in the line of the input signal, such a difficulty can be avoided and a higher image quality can be achieved. That is, in this difficulty, a displayed image instantaneously collapses due to out-of-synchronization of the sync signal.

However, even when a picture signal to be inputted is switched from a deteriorated image quality condition to a better image quality condition, since the phase difference contained in the phase difference judging signal 38*k* outputted from the phase difference judging circuit 38*i* maintains the accumulated value, the phase difference in this case is nearly equal to the deteriorated image quality condition. As a consequence, since the reset position judging unit 38*p* judges that no state change occurs under this condition, such a state of non-resettable operation is selected.

On the other hand, when the resetting operation is performed in a positional relationship under better condition, such a fact is known that the subsequent image processing operations may be carried out under better condition. Although the present state has already been transferred to the better state, the correct judgment cannot be made, resulting in the adverse influence. Accordingly, in the pixel timing adjusting apparatus 30, the pixel difference calculating circuit 38*n* for calculating a shift amount of pixel numbers within a 1H line is provided. As explained above, the shift amount 38*r* of the 1H pixel numbers is calculated in the pixel difference calculating circuit 38*n*, and then, this shift amount 38*r* is supplied to the reset position judging unit 38*p*. Even when the phase difference is large, if the shift amount 38*r* of the 1H pixel number is small, then this condition implies that a picture signal produced under better condition is supplied.

The reset position judging circuit 38*i* can correctly judge a condition of a picture signal which is presently supplied with reference to the shift amount 38*r* of the 1H pixel number derived from the pixel difference calculating circuit 38*n*. The shift amount 38*r* of the 1H pixel number may be judged by checking as to whether or not this shift amount 38*r* is smaller than, or equal to a previously-set condition judgment threshold. When the shift amount 38*r* of the 1H pixel number is smaller than, or equal to the condition judgment threshold, the reset position judging circuit 38*i* judges that the condition of the presently-supplied picture signal is brought into the better condition, so that a reset signal 38*s* is produced therefrom. The reset position judging circuit 38*i* supplies this produced reset signal 38*s* as the synthetic counter control signal 38D via the OR gate 38*j* to the read counter 38*b*, and inserts this synthetic count control signal 38D just after, for example, an effective line of the input signal so as to reset the read counter 38*b*.

As previously explained, since the reset signal is supplied by considering also the changes in the sorts of picture signals to be inputted, the position of the resetting operation is automatically adjusted to be followed, so that the high-performance pixel timing adjusting apparatus can be accomplished which can provide the pictures having the better image qualities even for any sorts of pictures.

With employment of the above-described arrangement, in the pixel timing adjusting apparatus 10, the phase difference is considered in the read control unit 18. In the read adjusting circuit 18*d*, both the write address 14*f* of the final pixel and the difference 12*g* of the pixel numbers are stored in the register 18*c* in response to both the write permission control signal 14*e* and the judgment result of the pixel number smaller than the predetermined pixel number by the 1H judging unit 12; the write address 14*f* of the final pixel from the commencement of the reading operation is compared with the read address 18*g* supplied to the FIFO memory 16; and the read adjusting circuit 18*d* judges that the present pixel is reached to the final pixel in the smaller pixel number due to a coincidence of the comparison result, and produces both the write address 14*f* of the final pixel and the selection control signal 18*n* plural times which are indicated by the difference 12*g* of the pixel numbers stored in the register 18*c*. During this time period, since the write address 14*f* of the final pixel is supplied from the selection circuit 18*e* as the read address 18*p* to the FIFO memory 16, the smaller pixels are compensated by the final pixel. After this process operation, the storage content of the register 18*c* is reset by the read adjusting circuit 18*d*. As a result, since such pixels having the higher correlative characteristics and the small pixel values are outputted, the flickering noise occurred on the edges of the display screen can be properly prevented, and such a picture having high image qualities can be provided, the pixel number per line of which is managed.

Also, in the pixel timing adjusting apparatus 30, while the FIFO memory 36 having the memory capacity larger than, or equal to 1 line is employed, a detection is made of a shift between a predetermined value and the count value of the input data which is obtained by sampling the picture signal supplied from the read control unit 38 every 1 line, and then, this shift is stored every line. Among these shifts, since the phase difference is increased in combination with the shifts of the pixel numbers along the smaller direction, even when this phase difference is increased, the avoiding process operation with respect to the read address and also the absorbing operation of the stored shifts are carried out in order not to be adversely influenced, and the reading control is continuously carried out. As a consequence, the upper/lower deviation on the display screen, and also the continuation of the disturbance occurred in a half way of the display screen can be prevented, and the pictures having the higher image qualities can be provided.

In the read control unit 38, the read control circuit 38*a* judges the elapse of the phase difference; the read counter control signal 38*d* is supplied to the produced read counter 38*b* so as to output the read address 38*e*; the address judging unit 38*c* judges as to whether or not the write address 14*f* of the final pixel supplied by the write control unit 34 is made coincident with the read address 38*e* of the read counter 38*b*, supplies the output prohibit signal 38*f* to the read counter 38*b* in response to the address coincidence in order to prohibit the counting operation of this read counter 38*b* for 1 count, and executes the writing operation having a top priority, and then executes the reading operation so as to continue the reading control operation, so that the upper/lower deviation on the display screen and the continuation of the disturbance occurred in a half way of the display screen can be prevented.

In the read control unit 38, the write address 34*d* is initialized by using the horizontal sync signal 12*d* obtained from the entered picture signal during the write operation to the FIFO memory 36, and the reading operation is continuously carried out in a constant interval. As a result, the picture having the higher image quality, the pixel numbers per line of which are managed, can be provided.

In addition to the above-described structure, in the read control unit 38, the reading operation of the FIFO memory 36 is initialized by employing the vertical sync signal 38*g* obtained from the picture signal to be inputted. As a consequence, the upper/lower deviation on the display screen, and also the continuation of the disturbance occurred in a half way of the display screen can be prevented, and the pictures having the higher image qualities can be provided.

In the read control unit 38, the adjusting reset signal 38*h* is supplied from the external unit in the manual manner in response to the entered picture signal. The reset position in the reading operation of the FIFO memory 36 is variably changed. As a result, the picture having the higher image quality, the pixel numbers per line of which are managed, can be obtained.

In the read control unit 38, the phase difference judging circuit 38*i* judges as to whether or not the magnitude of the phase difference is defined within the allowable range. When the magnitude of the phase difference exceeds the allowable range, the read control unit 38 controls the commencement of the reading operation with respect to the read counter 38*b* via the timing control unit 38A, initializes the reading operation from the FIFO memory 36, or variably controls the resetting position. As a result, even when the picture signals own the different natures, the pictures having the higher image qualities can be provided, the pixel numbers per line of which are managed.

As to the read control unit 38, in the timing control unit 38A, the shift amount 38*r* of the pixel numbers within 1 line is supplied to the reset position judging unit 38*p* by the pixel difference calculating circuit 38*n*. Then, the reset position judging unit 38*p* judges whether or not the resetting operation is allowed by combining this shift amount 38*r* with the phase difference judging signal 38*k* of the phase difference judging circuit 38*i*, and thus resets the read counter 38*b*. As a result, the picture having the higher image quality can be provided, the pixel numbers per line of which are correctly managed.

As previously described, in accordance with the image processing apparatus of the present invention, while the phase difference is considered in the read control means, in the read adjusting means, both the write address of the final pixel and the difference of the pixel numbers are stored in the register in response to both the write permission control signal and the judgment result of the pixel number smaller than the predetermined pixel number by the line judging means; the write address of the final pixel from the commencement of the reading operation is compared with the read address supplied to the memory means; and the read adjusting means judges that the present pixel is reached to the final pixel in the smaller pixel number due to a coincidence of the comparison result, and produces both the write address of the final pixel and the selection control signal plural times which are indicated by the difference of the pixel numbers stored in the register. During this time period, since the write address of the final pixel is supplied from the selection means as the read address to the memory means, the smaller pixels are compensated by the final pixel. As a result, since such pixels having the higher correlative characteristics and the small pixel values are outputted, the flickering noise occurred on the edges of the display screen can be properly prevented, and such a picture having high image qualities can be provided, the pixel number per line of which is managed.

Also, in accordance with the image processing apparatus of the present invention, a detection is made of a shift produced between a predetermined value and the count value of the input data which is obtained by sampling the picture signal supplied from the read control means every 1 line, and then, this shift is stored every line. Among these shifts, since the phase difference is increased in combination with the shifts of the pixel numbers along the smaller direction, even when this phase difference is increased, the avoiding process operation with respect to the read address and also the absorbing operation of the store shifts are carried out in order not to be adversely influenced, and the reading control is continuously carried out. As a consequence, the upper/lower deviation on the display screen, and also the continuation of the disturbance occurred in a half way of the display screen can be prevented, and the pictures having the higher image qualities can be provided.

What is claimed is:

1. An image processing apparatus comprising:

a memory circuit storing an input data in response to a write address and outputting an output data in response to a read address;

a one-line judging circuit receiving a horizontal synchronization signal and a sampling clock signal, the one-line judging circuit comparing a number of pixels sampled within one line of the horizontal synchronization signal with a predetermined number so as to output a comparison signal and a difference signal representing a difference between the sampled number of pixels and a predetermined number;

a write control circuit coupled to the memory circuit and the one-line judging circuit, the write control circuit generating the write address in response to the sampling clock signal and the comparison signal and a read control signal in response to the comparison signal; and a read control circuit coupled to the memory circuit, the write control circuit and the one-line judging circuit, the read control circuit generating the read address in response to the write address, the read control signal and the difference signal.

2. An image processing apparatus according to claim 1, wherein a storage capacity of the memory circuit is smaller than the number of pixels sampled within one line of the horizontal synchronization signal.

3. An image processing apparatus according to claim 1, wherein the one-line judging circuit includes a counter counting the sampling clock signal in response to the horizontal synchronization signal, and a pixel determination circuit coupled to the counter for generating the comparison signal and the difference signal in response to an output signal from the counter.

4. An image processing apparatus according to claim 1, wherein the write control circuit includes a control circuit generating a write counter control signal and the read control signal in response to the comparison signal, and a write counter generating the write address in response to the sampling clock signal and the write counter control signal.

5. An image processing apparatus according to claim 1, wherein the write control circuit receives the difference signal.

6. An image processing apparatus according to claim 1, wherein the read control circuit includes a control circuit receives the write address and the read control signal and generates a read address in response to the received signals, a register stores the write address and the difference signal and outputs the stored write address, a read adjusting circuit compares the write address received from the control circuit with the stored write signal received from the register and outputs a switching signal in response to the comparison thereof, and a selection circuit selectively outputs the write address received from the control circuit or the stored write signal received from the register in response to the switching signal.

7. An image processing apparatus according to claim 6, wherein the control circuit includes a reading control circuit receives the write address and the read control signal and generates a read counter control signal in response to the received signals, and a read counter outputs the read address in response to the read counter control signal and the sampling clock signal.

8. An image processing apparatus comprising:

a memory circuit having a capacity of n, the memory circuit storing an input data in response to a write address and outputting an output data in response to a read address;

a counter counting a sampling clock signal in response to a horizontal synchronization signal and outputting a counting signal;

a write control circuit coupled to the memory circuit and the counter, the write control circuit generating the write address in response to the sampling clock signal, the horizontal synchronization signal and the counting signal; and a read control circuit coupled to the memory circuit and the write control circuit, the read control circuit generating the read address in response to the write address, the sampling clock signal and a phase difference signal representing n/2, wherein n is a natural number.

9. An image processing apparatus according to claim 8, wherein the write control circuit includes a control circuit generating a write counter control signal in response to the counting signal, and a write counter generating the write address in response to the sampling clock signal, the horizontal synchronization signal and the write counter control signal.

10. An image processing apparatus according to claim 8, wherein the write control circuit compares the counting signal with the horizontal synchronization signal.

11. An image processing apparatus according to claim 8, wherein the read control circuit includes a control circuit receives the write address and the phase difference signal and generates the read address in response to the received signals, the control circuit stopping generation of the read address in response to an output prohibit signal, and an address determination circuit compares the read address received from the control circuit with the write signal received from the write control circuit and outputs the output prohibit signal when the read address received from the control circuit is coincident with the write signal received from the write control circuit.

12. An image processing apparatus according to claim 11, wherein the control circuit includes a reading control circuit receives the write address and the phase difference signal and generates a read counter control signal in response to the received signals, and a read counter outputs the read address in response to the read counter control signal and the sampling clock signal, the read counter stopping generation of the read address in response to the output prohibit signal.

13. An image processing apparatus according to claim 11, wherein the control circuit is reset in response to a horizontal synchronization signal received thereto.

14. An image processing apparatus according to claim 12, further comprising a logic circuit providing the read control signal and the output prohibit signal in response to a horizontal synchronization signal received thereto.

15. An image processing apparatus comprising:

a memory circuit having a capacity of n, the memory circuit storing an input data in response to a write address and outputting an output data in response to a read address;

a counter counting a sampling clock signal in response to a horizontal synchronization signal and outputting a counting signal;

a write control circuit coupled to the memory circuit and the counter, the write control circuit generating the write address in response to the sampling clock signal, the horizontal synchronization signal and the counting signal; and a read control circuit coupled to the memory circuit and the write control circuit, the read control circuit generating the read address when the read control circuit detects a phase difference representing n/2 based on the write address and the sampling clock signal, wherein n is a natural number.

16. An image processing apparatus according to claim 15, wherein the write control circuit includes a control circuit generating a write counter control signal in response to the counting signal, and a write counter generating the write address in response to the sampling clock signal, the horizontal synchronization signal and the write counter control signal.

17. An image processing apparatus according to claim 15, wherein the write control circuit compares the counting signal with the horizontal synchronization signal.

18. An image processing apparatus according to claim 15, wherein the read control circuit includes a control circuit generates the read address in response to the write address and the sampling clock signal, the control circuit stopping generation of the read address in response to an output prohibit signal, and an address determination circuit compares the read address received from the control circuit with the write signal received from the write control circuit and outputs the output prohibit signal when the read address received from the control circuit is coincident with the write signal received from the write control circuit.

19. An image processing apparatus according to claim 18, wherein the control circuit includes a reading control circuit receives the write address and generates a read counter control signal in response to the write address, and a read counter outputs the read address in response to the read counter control signal and the sampling clock signal, the read counter stopping generation of the read address in response to the output prohibit signal.

20. An image processing apparatus according to claim 18, wherein the control circuit is reset in response to a reset signal received from an outside.

* * * * *